US010184631B2

(12) United States Patent
Sato

(10) Patent No.: US 10,184,631 B2
(45) Date of Patent: Jan. 22, 2019

(54) VEHICULAR HEADLAMP

(71) Applicant: KOITO MANUFACTURING CO., LTD., Tokyo (JP)

(72) Inventor: Noriko Sato, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/588,988

(22) Filed: May 8, 2017

(65) Prior Publication Data

US 2017/0328534 A1 Nov. 16, 2017

(30) Foreign Application Priority Data

May 13, 2016 (JP) ..... 2016-097391

(51) Int. Cl.

| | |
|---|---|
| ***F21S 41/19*** | (2018.01) |
| ***F21S 41/14*** | (2018.01) |
| ***F21S 41/20*** | (2018.01) |
| ***F21S 41/255*** | (2018.01) |
| ***F21S 41/32*** | (2018.01) |
| ***F21S 41/663*** | (2018.01) |
| ***F21S 41/675*** | (2018.01) |
| ***F21S 41/16*** | (2018.01) |

(52) U.S. Cl.

CPC ..... *F21S 41/19* (2018.01); *F21S 41/14* (2018.01); *F21S 41/16* (2018.01); *F21S 41/255* (2018.01); *F21S 41/285* (2018.01); *F21S 41/321* (2018.01); *F21S 41/663* (2018.01); *F21S 41/675* (2018.01)

(58) Field of Classification Search

CPC ..... F21S 41/19; F21S 41/16; F21S 41/675; F21S 41/663; F21S 41/255; F21S 41/285; F21S 41/14; F21S 41/321

See application file for complete search history.

(56) References Cited

U.S. PATENT DOCUMENTS

| | | | | |
|---|---|---|---|---|
| 9,874,330 | B2 * | 1/2018 | Shimizu | F21S 41/36 |
| 2011/0222265 | A1 * | 9/2011 | Drenten | F21V 9/08 362/84 |
| 2013/0058114 | A1 * | 3/2013 | Reiners | F21S 48/1225 362/510 |
| 2014/0029282 | A1 * | 1/2014 | Ravier | F21S 41/14 362/510 |
| 2014/0175978 | A1 * | 6/2014 | Kobayashi | B60Q 1/1423 315/82 |
| 2014/0204398 | A1 * | 7/2014 | Sato | B60Q 1/0023 356/614 |
| 2014/0254188 | A1 * | 9/2014 | Masuda | B60Q 1/0023 362/521 |

(Continued)

FOREIGN PATENT DOCUMENTS

JP 2014-065499 A 4/2014

*Primary Examiner* — Donald L Raleigh

(74) *Attorney, Agent, or Firm* — Sughrue Mion, PLLC

(57) ABSTRACT

A vehicular headlamp includes a plurality of excitation light sources; a fluorescent body; a scanning mechanism configured to perform scanning by directing lights emitted from the excitation light sources toward the fluorescent body; and a projection lens through which the lights emitted from the fluorescent body pass such that a light distribution pattern is formed. Irradiation areas of the lights emitted from the excitation light sources and incident on the fluorescent body are different from each other.

9 Claims, 8 Drawing Sheets

(56) References Cited

U.S. PATENT DOCUMENTS

| | | | | |
|---|---|---|---|---|
| 2015/0062943 | A1* | 3/2015 | Takahira | B60Q 1/0023 362/510 |
| 2015/0130932 | A1* | 5/2015 | Vredenborg | A61B 5/1077 348/140 |
| 2015/0362154 | A1* | 12/2015 | Liao | F21V 9/40 362/84 |
| 2015/0369437 | A1* | 12/2015 | Reinprecht | F21S 48/1225 362/510 |
| 2015/0369440 | A1* | 12/2015 | Reinprecht | F21S 48/1757 362/510 |
| 2016/0131321 | A1* | 5/2016 | Yamanaka | F21S 48/1731 362/513 |
| 2016/0195232 | A1* | 7/2016 | Boinet | F21S 48/1225 362/510 |
| 2016/0312970 | A1* | 10/2016 | Suwa | F21S 45/10 |
| 2016/0312978 | A1* | 10/2016 | Park | F21V 7/0033 |
| 2017/0038582 | A1* | 2/2017 | Chau | G02B 27/0101 |
| 2017/0175968 | A1* | 6/2017 | Shimizu | F21S 41/24 |
| 2017/0334339 | A1* | 11/2017 | Kurashige | B60Q 1/1423 |
| 2017/0357004 | A1* | 12/2017 | Puente | F21S 43/13 |
| 2018/0031201 | A1* | 2/2018 | Seitz | F21S 48/1757 |
| 2018/0045392 | A1* | 2/2018 | Winterer | F21S 48/1145 |

* cited by examiner

VEHICULAR HEADLAMP

INCORPORATION BY REFERENCE

The disclosure of Japanese Patent Application No. 2016-097391 filed on May 13, 2016 including the specification, drawings and abstract is incorporated herein by reference in its entirety.

BACKGROUND

1. Technical Field

The disclosure relates to a vehicular headlamp that makes it possible to perform controls for achieving various light distribution patterns.

2. Description of Related Art

Japanese Patent Application Publication No. 2014-65499 (JP 2014-65499 A) describes a vehicular headlamp in which lights emitted from a pair of laser devices serving as light sources are reflected by a pair of microelectro mechanical system (MEMS) mirrors, and scanning is performed with the lights to form a light distribution pattern. The MEMS mirrors are disposed so as to face the laser devices, respectively, and are tiltable two-dimensionally.

SUMMARY

In JP 2014-65499 A, since the laser devices are disposed to be symmetrical in an upper-lower direction, and the MEMS mirrors are disposed to be symmetrical in the upper-lower direction in the vehicular headlamp, the maximum incident areas of the lights emitted from the upper and lower laser devices and incident on the fluorescent body through the upper and lower stationary MEMS mirrors are equal to each other. In a case where a plurality of lights are incident on the fluorescent body and light images of the lights on the fluorescent body have the same shape, flexibility may be insufficient for performing controls for achieving various light distribution patterns.

The disclosure provides a vehicular headlamp that makes it possible to perform controls for achieving various light distribution patterns.

An aspect of the disclosure relates to a vehicular headlamp including a plurality of excitation light sources; a fluorescent body; a scanning mechanism configured to perform scanning by directing lights emitted from the excitation light sources toward the fluorescent body; and a projection lens through which the lights emitted from the fluorescent body pass such that a light distribution pattern is formed. Irradiation areas of the lights emitted from the excitation light sources and incident on the fluorescent body are different from each other.

In the above-described configuration, shapes of light images formed by the lights emitted from the excitation light sources and incident on the fluorescent body are different from each other.

In the above-described aspect, a lens array may be provided between the excitation light sources and the scanning mechanism, the lens array including a plurality of light condensing parts disposed so as to face the excitation light sources, respectively; and the light condensing parts may have light condensing magnifications different from each other.

In the above-described configuration, since the light condensing parts, through which the lights pass, have light condensing magnifications different from each other, light images having shapes different from each other are formed by the lights emitted from the excitation light sources and incident on the fluorescent body.

In the above-described aspect, a lens array may be provided between the excitation light sources and the scanning mechanism, the lens array including a plurality of light condensing parts disposed so as to face the excitation light sources, respectively; and the light condensing parts and the excitation light sources may be disposed such that distances from the light condensing parts to the excitation light sources facing the light condensing parts, respectively, are different from each other.

The irradiation area of the light on the fluorescent body is determined based on a distance between each excitation light source and the light condensing part facing the excitation light source, in other words, a focal distance of the light emitted from each light condensing part. Therefore, in the above-described configuration, light images having shapes different from each other are formed by the lights emitted from the excitation light sources and incident on the fluorescent body.

In the above-described aspect, each of the light condensing parts may be configured to move with respect to a corresponding one of the excitation light sources facing the light condensing part such that the distance from the light condensing part to the corresponding one of the excitation light sources is changed, or each of the excitation light sources may be configured to move with respect to a corresponding one of the light condensing parts facing the excitation light source such that the distance from the excitation light source to the corresponding one of the light condensing parts is changed.

In the above-described configuration, by changing the distance between each of the excitation light sources and the corresponding light condensing part facing the excitation light source, an incident area of the light incident on the fluorescent body from the excitation light source is changed.

In the above-described aspect, light emitting parts of the excitation light sources may have shapes different from each other.

The irradiation area of the light on the fluorescent body is determined based on an emission area of the light emitting part of each excitation light source. Therefore, in the above-described configuration, light images having shapes different from each other are formed by the lights emitted from the excitation light sources and incident on the fluorescent body.

In the vehicular headlamp, light images having shapes different from each other are formed by the lights emitted from the excitation light sources and incident on the fluorescent body. This makes it possible to perform controls for achieving various light distribution patterns.

In the vehicular headlamp, it is possible to change the incident area of the light incident on the fluorescent body from each of the excitation light sources. Therefore, it is possible to perform controls for achieving more various light distribution patterns.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Herein below, embodiments of the disclosure are explained based on FIG. 1 to FIG. 8B. In these drawings, directions of a vehicular headlamp (an upper direction, a lower direction, a left direction, a right direction, a front direction, and a rear direction) are indicated as Up, Lo, Le, Ri, Fr, and Re, respectively.

Figure 1:
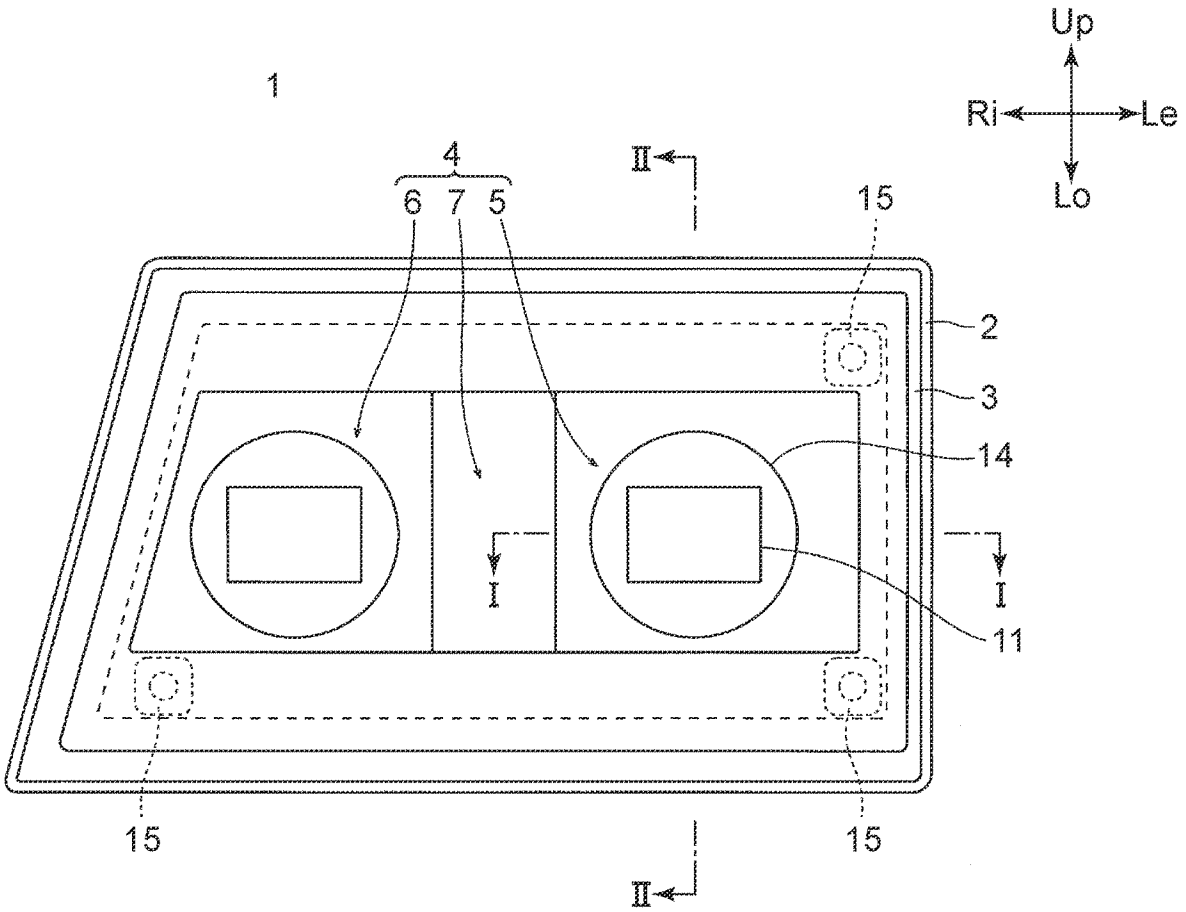
FIG. 1 is a front view of a vehicular headlamp according to a first embodiment.
Figure 2B:
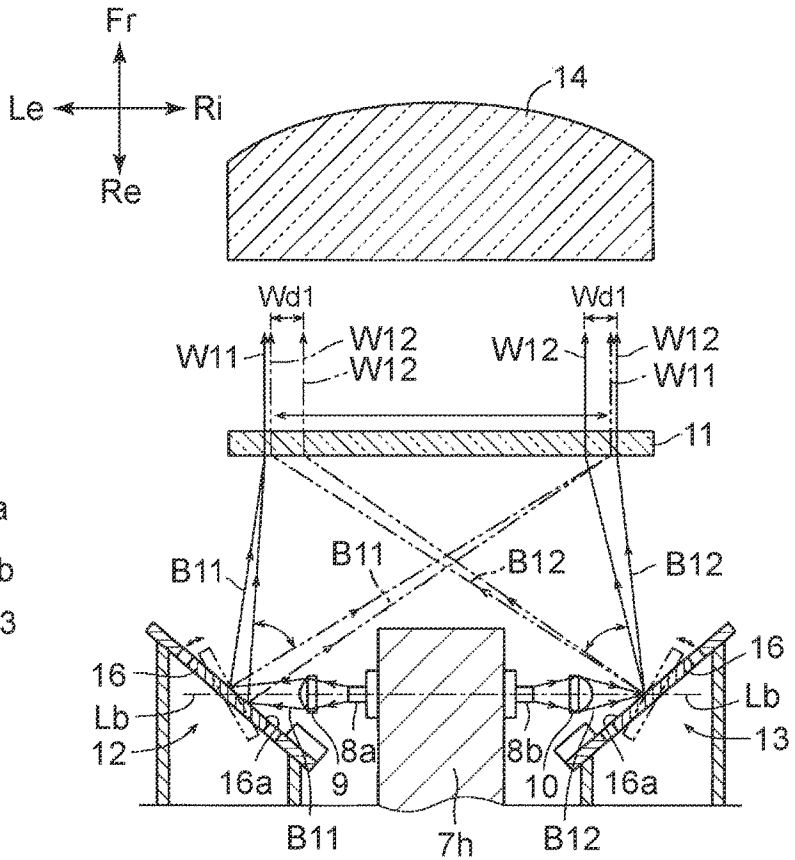
FIG. 2B is an explanatory view of optical paths in the vehicular headlamp according to the first embodiment.
Figure 2A:
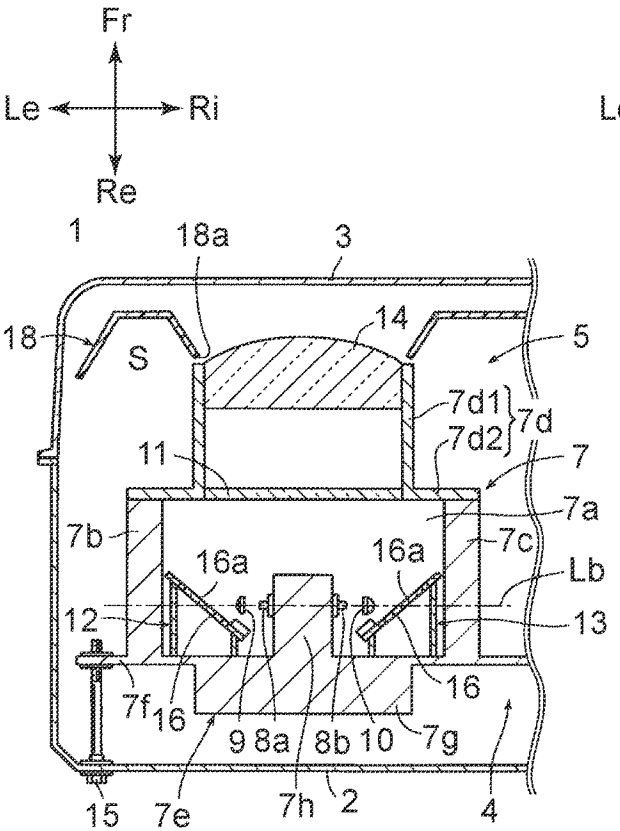
FIG. 2A is a transverse sectional view of the vehicular headlamp according to the first embodiment, which includes a light transmissive fluorescent body.

With reference to FIG. 1, FIG. 2A and FIG. 2B, a vehicular headlamp according to a first embodiment is explained. The vehicular headlamp 1 according to the first embodiment includes a transmissive fluorescent body 11. FIG. 2A is a transverse sectional view of the vehicular headlamp according to the first embodiment, taken along the line I-I in FIG. 1, and FIG. 2B is a view of optical paths formed by the vehicular headlamp 1. The vehicular headlamp 1 according to the first embodiment is an example of a right-side headlamp including a light-transmissive fluorescent body, and includes a lamp body 2, a front cover 3, and a headlamp unit 4. The lamp body 2 has an opening on the vehicle front side, and the front cover 3 is made of light-transmissive resin, glass or the like, and is attached to cover the opening of the lamp body 2. Thus, a lamp chamber S is formed inside the lamp body 2 and the front cover 3. The headlamp unit 4 shown in FIG. 1 is formed by integrating a high-beam headlamp unit 5 and a low-beam headlamp unit 6 with each other with the use of a support member 7 made of metal, and is disposed inside the lamp chamber S.

Each of the high-beam headlamp unit 5 and the low-beam headlamp unit 6 includes a pair of excitation light sources (8*a*, 8*b*), a pair of condenser lenses (9, 10), a fluorescent body 11, a pair of scanning mechanisms (12, 13), and a projection lens 14 in FIG. 2A, which are all attached to the support member 7. The support member 7 includes a plate-shaped bottom plate part 7*a* extending in the horizontal direction, a lens support part 7*d* extending toward the front side from an end of the bottom plate part 7*a*, and a plate-shaped foundation plate part 7*e* extending in the vertical direction from a base end of the bottom plate part.

The support member 7 shown in FIG. 2A is made of metal, and includes the bottom plate part 7*a*, side plate parts (7*b*, 7*c*) integrated with a left end part and a right end part of the bottom plate part 7*a*, a lens support part 7*d* integrated with distal ends of the side plate parts (7*b*, 7*c*), and the foundation plate part 7*e* integrated with base ends of the side plate parts (7*b*, 7*c*). The lens support part 7*d* is formed of a cylindrical part 7*d*1 that holds the projection lens 14 on its inner side, and a flange part 7*d*2 integrated with both the cylindrical part 7*d*1 and the side plate parts (7*b*, 7*c*). The foundation plate part 7*e* is formed of a screw fixing part 7*f*, a heat dissipation part 7*g* that is thicker in the front-rear direction than the screw fixing part 7*f*, and a rectangular column-shaped light source supporting part 7*h* that projects toward the front side from the heat dissipation part 7*g*.

The excitation light sources (8*a*, 8*b*) in FIG. 2A are fixed to left and right side surfaces of the light source supporting part 7*h* of the support member 7, respectively, such that the back sides of the excitation light sources (8*a*, 8*b*) face each other. In this case, as shown in FIG. 2B, optical axes of lights (B11, B12) from the excitation light sources (8*a*, 8*b*) to reflection surfaces of the scanning mechanisms (12, 13) become the same optical axis Lb in the opposite directions toward the left and right sides. The fluorescent body 11 is formed to have a plate shape and fixed to an inner side of a base end part of the cylindrical part 7*d*1 so as to face the projection lens 14. The scanning mechanisms (12, 13) are fixed to a front surface of the heat dissipation part 7*g*. The condenser lenses (9, 10) are fixed to either the bottom plate part 7*a* or the foundation plate part 7*e*. The projection lens 14 is fixed to an inner side of a distal end part of the cylindrical part 7*d*1 of the lens support part 7*d*. As shown in FIG. 2A, three aiming screws 15, which are held by the lamp body 2 so as to be able to turn, are screwed to the screw fixing part 7*f* of the foundation plate part 7*e* of the support member 7. Thus, the headlamp unit 4 shown in FIG. 1 is supported so as to be tiltable with respect to the lamp body 2.

The excitation light sources (8*a*, 8*b*) are constituted by blue or purple LED light sources or laser light sources. While the excitation light sources (8*a*, 8*b*) are lit, heat of the excitation light sources (8*a*, 8*b*) is dissipated through the light source supporting part 7*h* and the heat dissipation part 7*g*. The condenser lenses (9, 10) and the projection lens 14 are transparent or semitransparent planoconvex lenses having convex light emission surfaces.

The condenser lens 10 is formed so as to have the same outer diameter as that of the condenser lens 9 and also have a larger curvature than that of the condenser lens 9. Thus, the condenser lens 10 has a larger light condensing magnification than that of the condenser lens 9.

The condenser lenses (9, 10) shown in FIG. 2A and FIG. 2B are fixed to the support member 7 so as to be disposed between the excitation light sources (8*a*, 8*b*) and reflecting mirrors (16, 16) of the scanning mechanisms (12, 13), respectively. In other words, the condenser lenses (9, 10) are disposed to face the excitation light sources (8*a*, 8*b*), respectively. The condenser lenses (9, 10) condense the lights (B11, B12) from the excitation light sources (8*a*, 8*b*) and make them incident on the reflection surfaces (16*a*, 16*a*) of the reflecting mirrors (i.e., reflecting portions) (16, 16), respectively. The light B12 condensed onto the reflection surface 16*a* by the condensing lens 10 is condensed within a narrower area than an area of the light B11 that is condensed onto the reflection surface 16*a* by the condenser lens 9, that is, the light B12 is condensed into a single spot on the reflection surface 16*a*. Therefore, the light B12 reflected by the reflecting mirror 16 toward the fluorescent body 11 is diffused more than the light B11 reflected by the reflecting mirror 16 toward the fluorescent body 11. A light image displayed on the fluorescent body 11 by the light B12 has a larger width Wd1 than that of a point light image formed by the light B11.

The fluorescent body 11 is configured so as to generate white light. When the excitation light sources (8*a*, 8*b*) are blue, the fluorescent body 11 is formed as a yellow fluorescent body, and when the excitation light sources (8*a*, 8*b*) are purple, the fluorescent body 11 is formed as a yellow and blue fluorescent body or a fluorescent body having at least three colors of red, green and blue (RGB).

The fluorescent body 11 shown in FIG. 2A and FIG. 2B transmits the reflected lights (B11, B12) having different irradiation areas, toward the projection lens 14 as white lights (W11, W12), and further, these lights pass through a front end opening 18*a* of an extension reflector 18 inside the lamp chamber S, and the front cover 3. Scanning with the white lights (W11, W12) is performed by the scanning mechanisms (12, 13) to display white high-beam light distribution patterns in front of a vehicle based on the sizes of the respective irradiation areas.

Figure 3B:
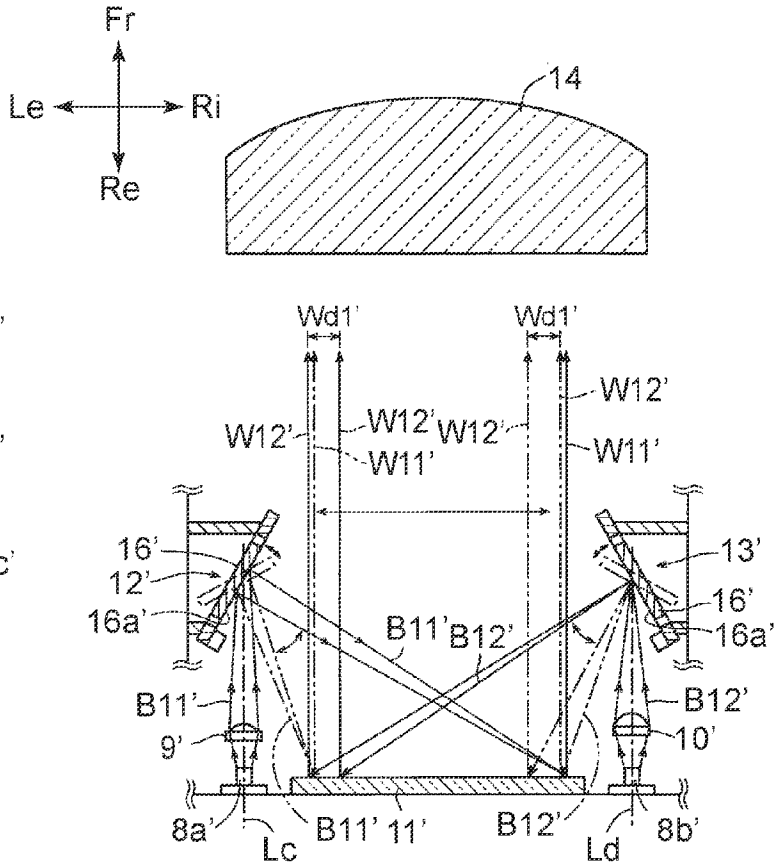
FIG. 3B is an explanatory view of optical paths in the vehicular headlamp according to the second embodiment.
Figure 3A:
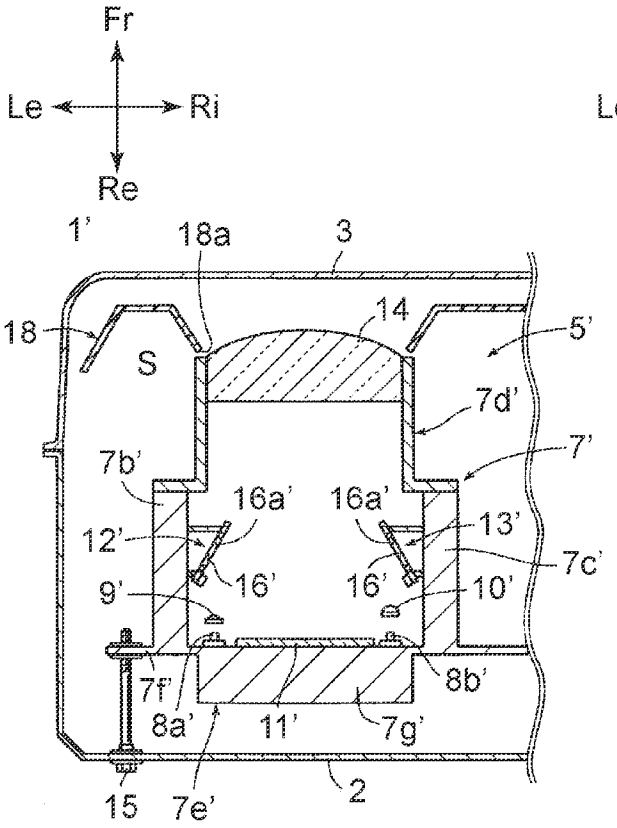
FIG. 3A is a transverse sectional view of a vehicular headlamp according to a second embodiment, which includes a light transmissive fluorescent body.

Next, a vehicular headlamp 1' according to a second embodiment is explained with reference to FIG. 3A and FIG. 3B. The vehicular headlamp 1' according to the second embodiment includes a reflective fluorescent body 11'. FIG. 3A is a transverse sectional view of the vehicular headlamp 1' according to the second embodiment, taken along the line I-I in FIG. 1, and FIG. 3B is a view of optical paths formed by the vehicular headlamp 1'. A high-beam headlamp unit 5' of the vehicular headlamp 1' in FIG. 3B has the same structure as that of the vehicular headlamp 1 according to the first embodiment, except that a shape of a support member 7' is different from that of the support member 7 in the first embodiment, and arrangement is different from those of the excitation light sources (8*a*, 8*b*), the condenser lenses (9, 10), the fluorescent body 11, and the scanning mechanisms (12, 13). Excitation light sources (8*a'*, 8*b'*), condenser lenses (9', 10'), a fluorescent body 11', and scanning mechanisms (12', 13') according to the second embodiment have the same structures as those of the excitation light sources (8*a*, 8*b*), the condenser lenses (9,10), the fluorescent body 11, and the scanning mechanisms (12, 13) according to the first embodiment, respectively.

As shown in FIG. 3A and FIG. 3B, a foundation plate part 7*e'* of the support member 7' in the second embodiment has a structure in which no light source supporting part 7*h* is provided in the foundation plate part 7*e* of the support member 7 in the first embodiment, and is formed of a screw fixing part 7*f'* and a heat dissipation part 7*g'* that is thicker in the front-rear direction than the screw fixing part 7*f'*. Also, unlike the first embodiment, the fluorescent body 11' according to the second embodiment is not fixed to the lens support part 7*d'* and is fixed to the heat dissipation part 7*g'* of the support member 7'. The excitation light sources (8*a'*, 8*b'*) are fixed to the heat dissipation part 7*g'* in a state where the excitation light sources (8*a'*, 8*b'*) are disposed on the left side and right side of the fluorescent body 11', respectively. While the excitation light sources (8*a'*, 8*b'*) are lit, heat of the excitation light sources (8*a'*, 8*b'*) is thus dissipated. In this case, optical axes (Lc, Ld) of lights from the pair of excitation light sources (8*a'*, 8*b'*) to reflection surfaces of the scanning mechanisms (12', 13') are directed in the same direction, and are parallel to each other.

The scanning mechanisms (12', 13') according to the second embodiment in FIG. 3A are not fixed to the heat dissipation part 7*g'*, and are fixed to inner sides of left and right side plate parts (7*b'*, 7*c'*), respectively. The condenser lenses (9', 10') are fixed to the support member 7' so as to be disposed between the excitation light sources (8*a'*, 8*b'*) and the reflecting mirrors (16', 16') of the scanning mechanisms (12', 13'), respectively, and the fluorescent body 11' is fixed to the support member 7' so as to face both the reflection surfaces (16*a'*, 16*a'*) of the reflecting mirrors (16', 16') and the projection lens 14 attached to the lens support part 7*d'*.

The lights (B11', B12') emitted from the excitation light sources (8*a'*, 8*b'*) and passing through the condenser lenses (9', 10') in FIG. 3A and FIG. 3B are condensed onto the reflection surfaces (16*a'*, 16*a'*) of the reflecting mirrors (16', 16'), and are diffused and reflected by the reflection surfaces (16*a'*, 16*a'*), and then the lights (B11', B12') are incident on the fluorescent body 11'. The condenser lens 10' has a larger light condensing magnification than that of the condenser lens 9', and the light B12' reflected toward the fluorescent body 11' is incident on the fluorescent body 11' in a state where the light B12' is diffused more than the light B11'. Therefore, a light image displayed on the fluorescent body 11' by the light B12' has a larger width Wd1' than that of a point light image formed by the light B11'.

The fluorescent body 11' in FIG. 3A and FIG. 3B reflect the lights (B11', B12') again toward the projection lens 14 as white lights (W11', W12'), and the scanning mechanisms (12', 13') perform scanning with the white lights (W11', W12') that pass through the projection lens 14 and the front cover 3, to display white high-beam light distribution patterns in front of a vehicle based on sizes of the irradiation areas. The pairs of excitation light sources in each of the first and second embodiments may be controlled to be turned on and off independently of each other by a lighting controller (not shown).

Figure 4A:
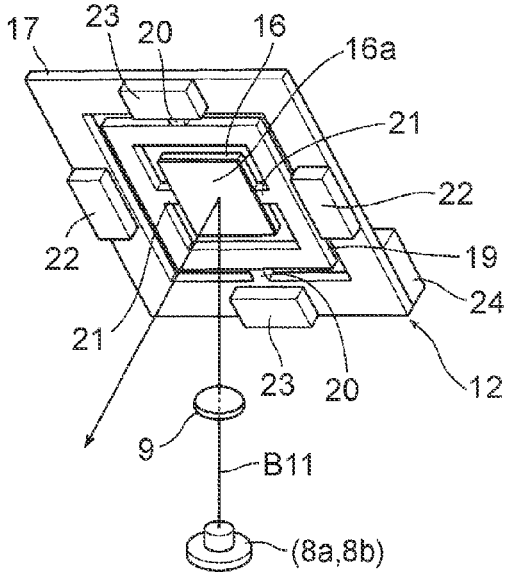
FIG. 4A is a perspective view of a scanning mechanism according to each of the first and second embodiments, obliquely seen from the front side of a reflecting mirror.

All the scanning mechanisms (12, 13, 12', 13') according to the first and second embodiments shown in FIG. 2A and FIG. 3A have the same structure, and the reflecting mirror 16 and the reflection surface 16*a* have the same structures as those of the reflecting mirror 16' and the reflection surface 16*a'*, respectively. The scanning mechanism 12 shown in FIG. 4A is a scanning device having a reflecting mirror that is tiltable in two axes directions. In each of the scanning mechanisms according to the embodiments, a MEMS mirror is used as an example. However, as each of the scanning mechanisms, various scanning mechanisms, for example, a scanning mechanism including a Galvano mirror, may be employed. The scanning mechanism 12 includes the reflecting mirror 16, a base 17, a turning body 19, a pair of first torsion bars 20, a pair of second torsion bars 21, a pair of permanent magnets 22, a pair of permanent magnets 23, and a terminal part 24. On a front surface of the reflecting mirror 16, a reflection surface 16*a* is formed by, for example, treatment such as silver deposition and plating.

The base 17 supports the plate-shaped turning body 19 such that the turning body 19 is tilted by the pair of first torsion bars 20 in the right-left direction (i.e., toward the right and left sides). The turning body 19 supports the reflecting mirror 16 such that the reflecting mirror 16 is turned by the pair of second torsion bars 21 in the upper-lower direction (i.e., toward the upper and lower sides). The pair of permanent magnets 22 and the pair of permanent magnets 23 are provided in the base 17 in directions in which the pairs of the first and second torsion bars (20, 21) extend, respectively. The reflecting mirror 16 and the turning body 19 are provided with first and second coils (not shown), respectively, which are energized through the terminal part 24. An energization control for the first coil (not shown) and an energization control for the second coil (not shown) are performed independently of each other by a control mechanism (not shown).

The turning body 19 shown in FIG. 4A tilts in a reciprocating manner toward the left and right sides about an axis of the first torsion bars 20 based on ON or OFF of energization of the first coil (not shown). The reflecting mirror 16 (and 16') tilts in a reciprocating manner toward the upper and lower sides about an axis of the second torsion bars 21 based on ON or OFF of energization of the second coil (not shown). Scanning is performed in the right-left direction and the upper-lower direction with the lights (B11, B12, B11', B12') reflected by the reflection surfaces 16*a* (and 16*a'*) toward the fluorescent body (11, 11'), based on tilting of the turning body 19 in the right-left direction and tilting of the reflection surfaces 16*a* (and 16*a'*) in the upper-lower direction. As shown in FIG. 2B and FIG. 3B, lights (W11, W12, W11', W12'), which are turned into white by being passed through the fluorescent body 11 or being reflected by the fluorescent body 11', pass through the projection lens 14 and the front cover 3 while scanning is performed in the right-left direction and the upper-lower direction. Thus, a white light distribution pattern in a given shape is displayed in front of a vehicle based on a scanning mode.

Figure 4B:
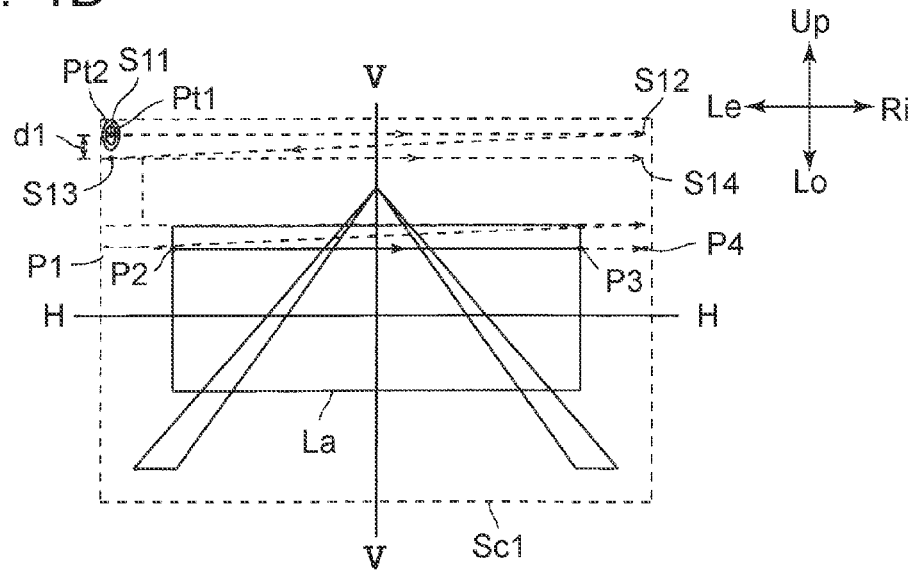
FIG. 4B is an explanatory view of a high-beam light distribution pattern formed by the vehicular headlamp according to each of the first and second embodiments.

With reference to FIG. 4B, a description is provided on an example of a light distribution pattern displayed in front of a vehicle by scanning performed by the high-beam headlamp unit 5. The reference numeral Pt1 indicates a light formed by the reflected lights (W11, W11') in FIG. 2B and FIG. 3B. The reference numeral Pt2 indicates a light image that is formed by the reflected lights (W12, W12') to be larger than the light image Pt1. Inside a rectangular scanning area (reference numeral Sc1) in front of a vehicle, the scanning mechanisms (12, 13, 12', 13') first perform scanning from a left end S11 to a right end S12 based on tilting of the reflecting mirrors 16, tilt the reflecting mirrors 16 in an obliquely lower left direction toward the next left end S13 that is slightly lower than the left end S11 by a minute distance d1, and then perform scanning again to a right end S14, and the scanning mechanisms (12, 13, 12', 13') repeat these at high speed. The excitation light sources (8*a*, 8*b*, 8*a'*, 8*b'*) are turned on by a lighting controller (not shown) only at a position where the light distribution pattern is displayed. Specifically, the excitation light sources (8*a*, 8*b*, 8*a'*, 8*b'*) are turned on only in a section from P2 to P3 where the light distribution pattern is displayed, and are turned off in a section from P1 to P2 and a section from P3 to P4, where the light distribution pattern is not displayed. While the excitation light sources (8*a*, 8*b*, 8*a'*, 8*b'*) are turned on and off at the given positions, the scanning mechanisms (12, 13, 12', 13') repeatedly perform the above-described scanning at high speed, and dispose line images in the upper-lower direction, thereby displaying a high-beam light distribution pattern La in front of a vehicle. The low-beam headlamp unit 6 also performs similar scanning, thereby displaying a low-beam light distribution pattern (not shown).

The excitation light sources (8*a*, 8*b*, 8*a'*, 8*b'*) are configured so as to be turned on and off by the lighting controller independently of each other. In each of the vehicular headlamps (1, 1') according to the first and second embodiments, in a case where only the excitation light source (8*a* or 8*a'*) is turned on and scanning is performed with the spotlight image Pt1, a drawing pattern made by disposing white thin lines is displayed in front of a vehicle (not shown). In a case where only the excitation light source (8*b* or 8*b'*) is turned on and scanning is performed with the light image Pt2 having a larger display area than that of the light image Pt1, a white drawing pattern made by disposing white thick lines is displayed in front of the vehicle. It is also possible to combine the white drawing patterns made of thin lines and thick lines, which are formed by turning on the pair of excitation light sources (8*a*, 8*b*) or (8*a'*, 8*b'*) simultaneously and by performing scanning simultaneously. In any case, controls for achieving various light distribution patterns can be performed.

Figure 5B:
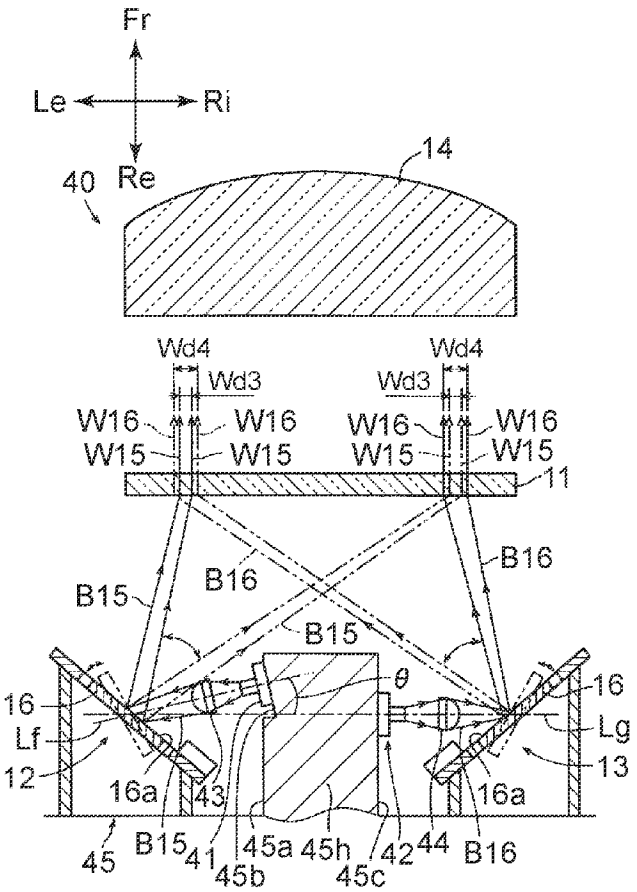
FIG. 5B is a partial transverse sectional view of a vehicular headlamp according to a fourth embodiment and its optical paths.
Figure 5A:
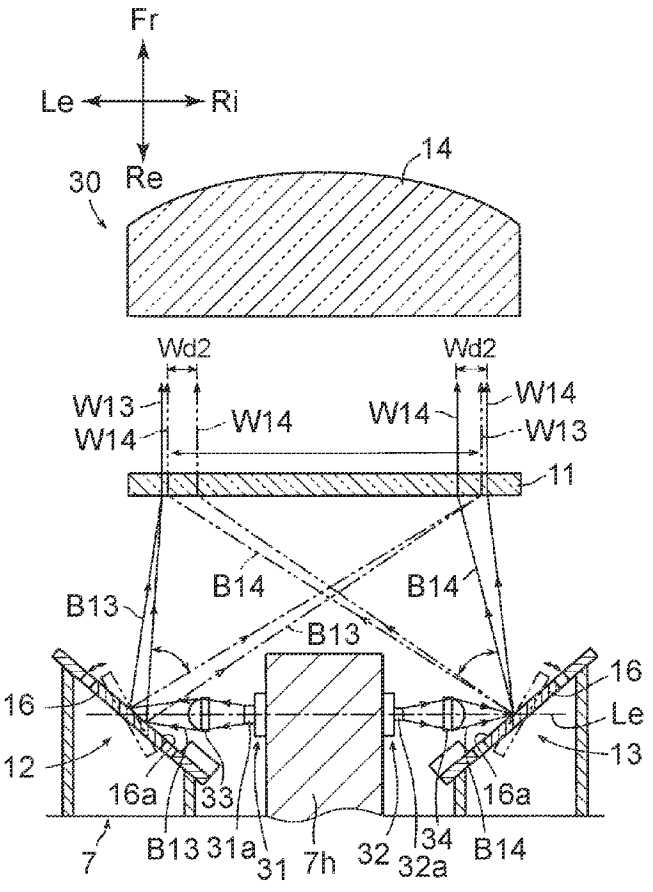
FIG. 5A is a partial transverse sectional view of a vehicular headlamp according to a third embodiment and its optical paths.

Next, a vehicular headlamp 30 according to a third embodiment is explained with reference to FIG. 5A. FIG. 5A is a transverse sectional view of a vehicular headlamp 30 according to the third embodiment taken along the line I-I in FIG. 1. The vehicular headlamp 30 and the vehicular headlamp 1 according to the first embodiment have a common structure except for structures of the excitation light sources (8*a*, 8*b*) and the condenser lenses (9,10). The vehicular headlamp 30 according to the third embodiment includes excitation light sources (31, 32), and condenser lenses (33, 34) having the same shape. A light emitting part 32*a* of the excitation light source 32 is formed to be smaller than a light emitting part 31*a* of the excitation light source 31. The paired excitation light sources (31, 32) are fixed to left and right side surfaces of a light source supporting part 7*h* of a support member 7, respectively, such that the back sides of the excitation light sources (31, 32) face each other. Lights (B13, B14) emitted from the excitation light sources (31, 32) and incident on reflecting mirrors 16 are directed in the opposite directions toward the left and right sides along a common optical axis Le. Arrangement intervals among the excitation light source 31 disposed on the light source supporting part 7*h* of the support member 7 made of metal, the condenser lens 33, and the reflecting mirror 16 are the same as arrangement intervals among the excitation light source 32, the condenser lens 34, and the reflecting mirror 16.

In this case, as shown in FIG. 5A, the light B14 emitted from the excitation light source 32 and is condensed onto a reflection surface 16*a* by the condenser lens 34 is condensed into a narrower area than an area of the light B13 that is emitted from the excitation light source 31 and is condensed onto the reflection surface 16*a* by the condenser lens 33. In other words, the light B14 is condensed into one spot on the reflection surface 16*a*. As a result, the reflected light B14 is diffused toward a fluorescent body more widely than the reflected light B13, and a light image displayed on the fluorescent body 11 by the reflected light B14 has a larger width Wd2 than that of a point light image formed by the reflected light B13. The lights (B13, B14) are turned into white lights (W13, W14) by being passed through the fluorescent body 11, and the white lights (W13, W14) pass through a projection lens 14 and a front cover (not shown).

In the vehicular headlamp 30, while the excitation light sources (31, 32) are turned on selectively or simultaneously, the reflecting mirrors (16, 16) of the scanning mechanisms (12, 13) are freely tilted. As in the case of the vehicular headlamp 1 according to the first embodiment, scanning is performed with the white lights (W13, W14) in the right-left direction repeatedly at high speed while scanning is shifted in the upper-lower direction by a given minute interval within a rectangular scanning area (indicated by Sc1) in front of a vehicle as shown in FIG. 4B. Thus, white thin lines formed by the light W13 and white thick lines formed by the light W14 are disposed, and thus, a white light distribution pattern in a given shape is displayed in front of a vehicle (not shown). The light emitting parts (31*a*, 32*a*) may be formed so as to have sectional shapes (for example, a circular shape, a quadrangular shape, and so on) different from each other.

Next, a vehicular headlamp 40 according to a fourth embodiment is explained with reference to FIG. 5B. FIG. 5B is a transverse sectional view of the vehicular headlamp 40 according to the fourth embodiment taken along the line I-I in FIG. 1, and the vehicular headlamp 40 and the vehicular headlamp 1 according to the first embodiment have a common structure except for the structures of the support member 7, the excitation light sources (8*a*, 8*b*) and the condenser lenses (9, 10). The vehicular headlamp 40 according to the fourth embodiment includes excitation light sources (41, 42) having the same shape, condenser lenses (43, 44) having the same shape, and a support member 45. The support member 45 has the same structure as that of the support member 7 except that the shape of a light source supporting part 45*h* is different from that of the light source supporting part 7*h*. The light source supporting part 45*h* is formed to have a rectangular parallelepiped column shape, and has an inclined support surface 45*b* that is continuous with a left side surface 45*a*. The inclined support surface 45*b* is formed so as to incline with respect to the left side surface 45*a*, and the excitation light source 41 is fixed to the inclined support surface 45*b*. The excitation light source 42 is fixed to a right side surface 45*c* of the light source supporting part 45*h*. An optical axis Lf of a light B15 that is emitted from the excitation light source 41 and is incident on a reflecting mirror 16 is inclined with respect to an optical axis Lg of a light B16 by an angle θ. The light B16 is emitted from the excitation light source 42 and is incident on a reflecting mirror 16.

As shown in FIG. 5B, an incidence angle of the light B15 incident on a reflection surface 16*a* of the reflecting mirror 16 is different from an incidence angle of the light B16 incident on a reflection surface 16*a*. Therefore, a light image, which is displayed on the reflection surface 16*a* by emitting the light B15 from the excitation light source 41 and condensing the light B15 with the use of the condenser lens 43, has a shape different from that of a light image, which is displayed on the reflection surface 16*a* of the reflecting mirror 16 by emitting the light B16 from the excitation light source 42 and condensing the light B16 with the use of the condenser lens 44. To be specific, a horizontal width of the light image displayed on the reflection surface 16*a* by the light B16 is narrower than that of the light image displayed on the reflection surface 16*a* by the light B15, and the reflected light B16 is diffused more in the horizontal direction than the reflected light B15. As a result, the light image displayed on the fluorescent body 11 by the reflected light B16 has a larger width Wd4 than a width Wd3 of the light image displayed by the reflected light B15. The lights (B15, B16) are turned into white lights (W15, W16) by being passed through the fluorescent body 11 and the white lights (W15, W16) pass through a projection lens 14 and a front cover (not shown).

In the vehicular headlamp 40, while the excitation light sources (41, 42) are turned on selectively or simultaneously, the reflecting mirrors (16, 16) of the scanning mechanisms (12, 13) are tilted freely. As in the case of the vehicular headlamp 1 according to the first embodiment, scanning is performed with the white lights (W15, W16) in the right-left direction repeatedly at high speed while scanning is shifted in the upper-lower direction by a given minute interval within a rectangular scanning area (indicated by Sc1) in front of a vehicle as shown in FIG. 4B. Thus, white thin lines formed by the light W15 and white thick lines formed by the light W16 are disposed, and thus, a white light distribution pattern in a given shape is displayed in front of a vehicle (not shown).

Figure 6A:
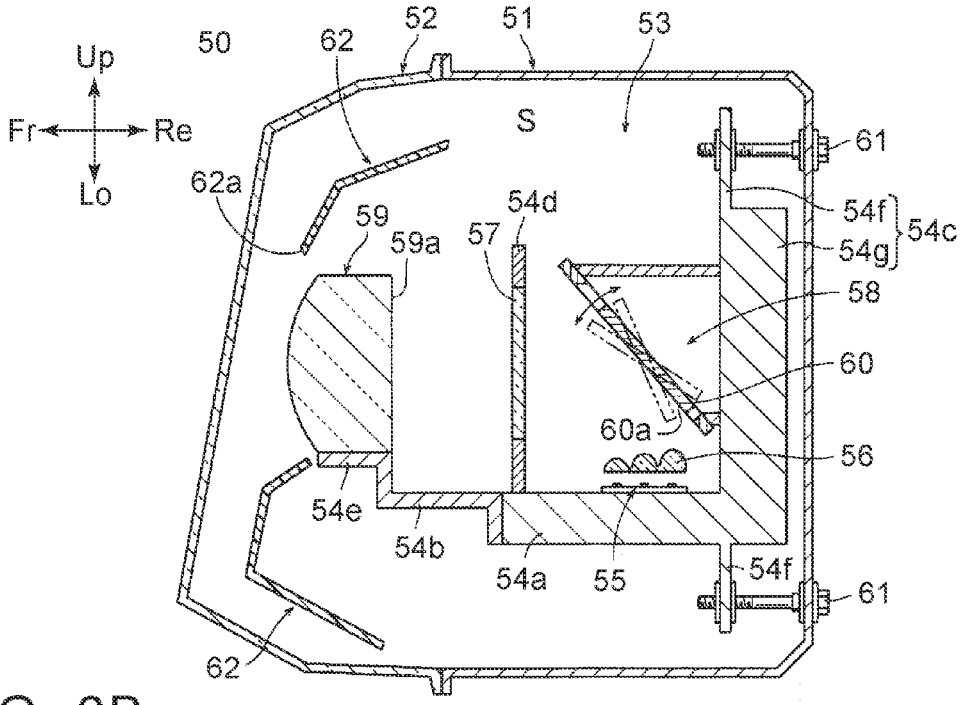
FIG. 6A is a vertical sectional view of a vehicular headlamp according to a fifth embodiment.
Figure 6B:
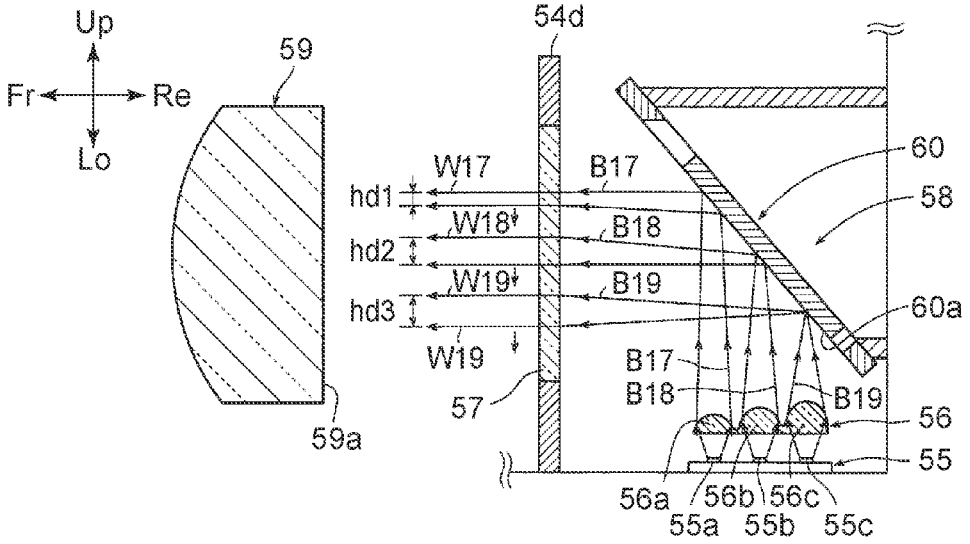
FIG. 6B is an explanatory view of optical paths formed by the vehicular headlamp according to the fifth embodiment, the optical paths seen from the left side.

Next, a vehicular headlamp 50 according to a fifth embodiment is explained with reference to FIG. 6A and FIG. 6B. FIG. 6A is a vertical sectional view of a vehicular headlamp 50 according to the fifth embodiment taken along the line II-II in FIG. 1, and FIG. 6B is a view of optical paths formed by the vehicular headlamp 50. The feature of the vehicular headlamp 50 is that the vehicular headlamp 50 includes an excitation light source array 55 including light emitting parts (55*a* to 55*c*) forming a plurality of excitation light sources, and a lens array 56 including a plurality of light condensing parts (56*a* to 56*c*) having different light condensing magnifications. The vehicular headlamp 50 includes a lamp body 51, and a high-beam headlamp unit 53 and a low-beam headlamp unit (not shown) having the same shape as that of the high-beam headlamp unit 53, within a lamp chamber S inward of a light-transmissive front cover 52. The high-beam headlamp unit 53 is fixed inside the lamp chamber S together with the low-beam headlamp unit (not shown) through a support member 54 made of metal.

As shown in FIG. 6A, the high-beam headlamp unit 53 includes the excitation light source array 55, the lens array 56, a fluorescent body 57, a scanning mechanism 58, and a projection lens 59, all of which are attached to the support member 54. The support member 54 includes a plate-shaped bottom plate part 54*a* extending in the horizontal direction, a step-shaped lens support part 54*b* integrated with a distal end of the bottom plate part 54*a* by welding or the like, a plate-shaped foundation plate part 54*c* extending in the vertical direction from a base end of the bottom plate part 54*a*, and a frame body 54*d* projecting upwardly from the bottom plate part 54*a*. The foundation plate part 54*c* is formed of a screw fixing part 54*f* and a holding part 54*g* that is thicker in the front-rear direction than the screw fixing part 54*f*.

As shown in FIG. 6A and FIG. 6B, the excitation light source array 55 includes a plurality of light emitting parts serving as excitation light sources constituted by blue or purple LED light sources or laser light sources, and these light emitting parts are a first light emitting part 55*a*, a second light emitting part 55*b*, and a third light emitting part 55*c* arranged in the front-rear direction. All of the first to third light emitting parts (55*a* to 55*c*) have the same shape, and emit light upwardly. While the excitation light source array 55 is lit, heat generated in the excitation light source array 55 is dissipated through the bottom plate part 54*a* of the support member 54 made of metal.

As shown in FIG. 6A and FIG. 6B, the lens array 56 has a shape in which the first light condensing part 56*a*, the second light condensing part 56*b* and the third light condensing part 56*c* having planoconvex lens shapes with different thicknesses are continuously arranged in the front-rear direction. The first light condensing part 56*a*, the second light condensing part 56*b* and the third light condensing part 56*c* are transparent or semitransparent. When curvatures of the first to third light condensing parts (56*a* to 56*c*) are Q1, Q2, Q3, and their light condensing magnifications are Sb1, Sb2, Sb3, respectively, the lens array 56 is formed such that the curvatures of the first to third light condensing parts (56*a* to 56*c*) satisfy the relation of Q1<Q2<Q3. Thus, the light condensing magnifications satisfy the relation of Sb1<Sb2<Sb3. The lens array 56 is fixed to either the bottom plate part 54*a* or the foundation plate part 54*c* of the support member 54 in a state where the first to third light condensing parts (56*a* to 56*c*) face the corresponding first to third light emitting parts (55*a* to 55*c*), respectively.

Figure 7:
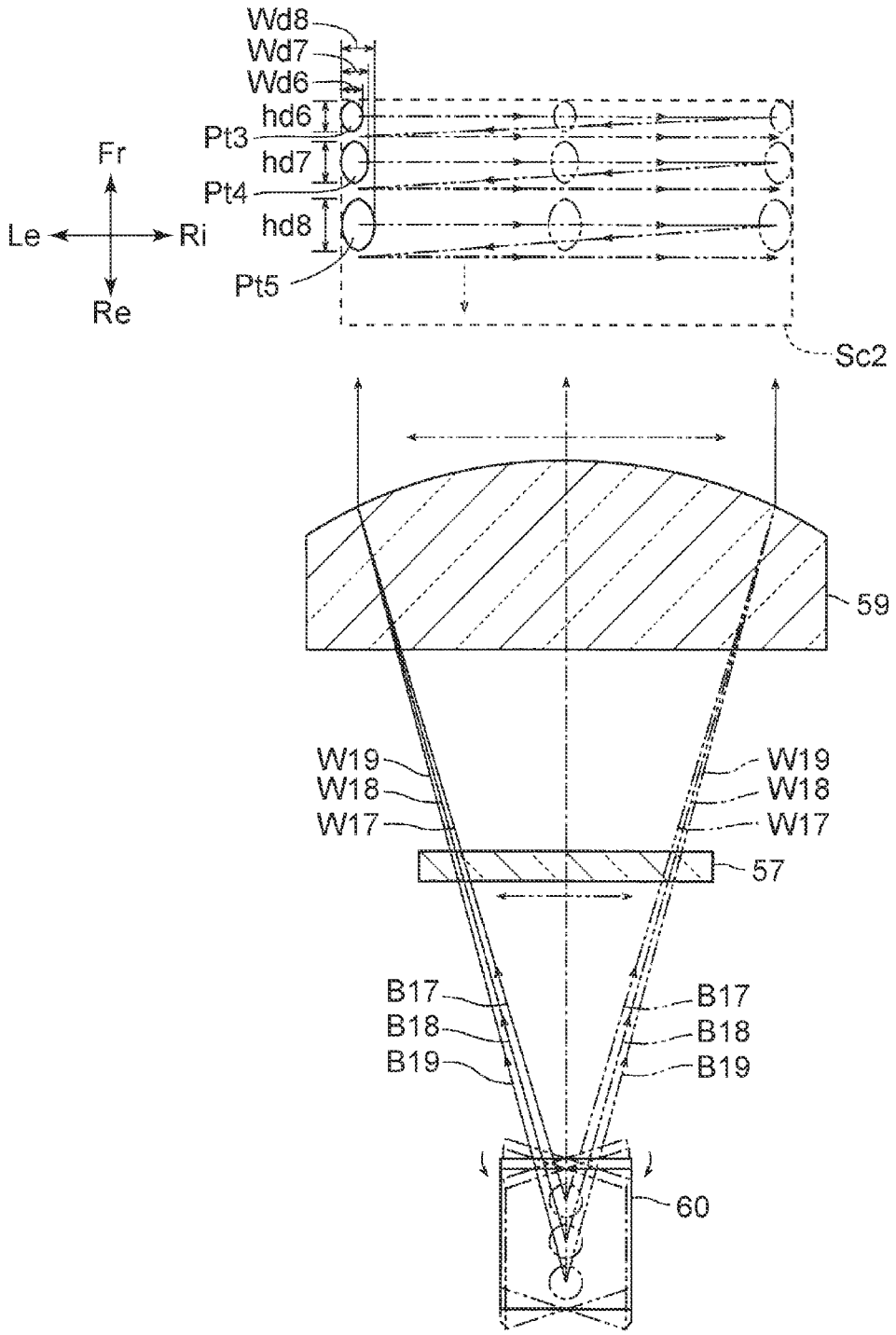
FIG. 7 is an explanatory view of optical paths and light images formed by the vehicular headlamp according to the fifth embodiment.

As shown in FIG. 6A and FIG. 6B, a fluorescent body 57 is formed as a yellow fluorescent body when the excitation light source array 55 generates blue light, and the fluorescent body 57 is formed as a yellow and blue fluorescent body or a fluorescent body having at least three colors of red, green and blue (RGB) when the excitation light source array 55 generates purple light. The fluorescent body 57 is fixed to the frame body 54*d* of the support member 54. The scanning mechanism 58 has a structure similar to that of the scanning mechanism 12 according to the first embodiment, and includes a reflecting mirror (i.e., reflecting portion) 60 that is configured so as to tilt freely in the upper-lower direction as shown in FIG. 6A and in the right-left direction as shown in FIG. 7. The reflecting mirror 60 is disposed such that a reflection surface 60*a* faces both the lens array 56 and the fluorescent body 57. The projection lens 59 is a planoconvex lens that is convex in the front direction (i.e., that protrudes toward the front side), and is held by a horizontal holding part 54*e* at a distal end of the lens support part 54*b* in a state where a rear surface 59*a* faces the fluorescent body 57. The support member 54, in which the high-beam headlamp unit 53 and the low-beam headlamp unit (not shown) are mounted, is supported by the lamp body 51 through three aiming screws 61 (one of which is not shown) such that the support member 54 is tiltable freely.

As shown in FIG. 6B, the first light condensing part 56*a*, the second light condensing part 56*b*, and the third light condensing part 56*c* of the lens array 56 condense lights (B17, B18, B19) emitted from the first light emitting part 55*a*, the second light emitting part 55*b*, and the third light emitting part 55*c* of the excitation light source array 55, respectively, and make the lights (B17, B18, B19) incident on the reflection surface 60*a* of the reflecting mirror 60. The light B19 condensed by the third light condensing part 56*c* is condensed into an area narrower than an area of the light B18 condensed by the second light condensing part 56*b*, and the light B18 condensed by the second light condensing part 56*b* is condensed into the area narrower than an area of the light B17 condensed by the first light condensing part 56*a*. The lights (B17, B18, B19) incident on different positions on the reflection surface 60*a* are reflected toward the fluorescent body 57.

As a result, as shown in FIG. 6B and FIG. 7, the reflected light B19 toward the fluorescent body 57 is diffused more widely than the reflected light B18, and the reflected light B18 is diffused more widely than the reflected light B17. As a result, a height hd3 of a light image displayed on the fluorescent body 57 by light B19 is larger than a height hd2 of a light image displayed on the fluorescent body 57 by the light B18, and the height hd2 of the light image displayed on the fluorescent body 57 by the light B18 is larger than a height hd1 of a light image displayed on the fluorescent body 57 by the light B17.

Further, as shown in FIG. 6A, FIG. 6B and FIG. 7, the lights (B17, B18, B19) are turned into white lights (W17, W18, W19) by the fluorescent body 57, and the white lights (W17, W18, W19) pass through the projection lens 59 and the front cover 52, and thus, light images (Pt3, Pt4, Pt5) are displayed in front of a vehicle (not shown). In this case, when widths and heights of the light images (Pt3, Pt4, Pt5) are Wd6, Wd7, Wd8 and hd6, hd7, hd8, respectively, the widths of the light images satisfy the relation of Wd6<Wd7<Wd8, and the heights of the light images satisfy the relation of hd6<hd7<hd8. Scanning is performed with the light images (Pt3, Pt4, Pt5) of the white lights (W17, W18, W19) that pass through the front cover 52, in the upper-lower direction and the right-left direction, based on tilting of the reflecting mirror 60 in the upper-lower direction and the right-left direction in the scanning mechanism 58 as shown in FIG. 6A, FIG. 6B and FIG. 7.

Specific explanation is provided with reference to FIG. 6B and FIG. 7. In the vehicular headlamp 50, while the first to third light emitting parts (55*a* to 55*c*) of the excitation light source array 55 shown in FIG. 6B are turned on selectively or simultaneously, the reflecting mirror 60 is tilted at high speed from a left end position to the right side within a rectangular scanning area Sc2 shown in FIG. 7 in front of a vehicle. Thus, white lines are drawn in the lateral direction based on the heights (hd6, hd7, hd8) of the light images (Pt3, Pt4, Pt5). Then, while the excitation light source array 55 is turned off, the reflecting mirror 60 is tilted at high speed to a left end position that is shifted in the lower direction from the previous left end position by a given minute interval. Then, the excitation light source array 55 is turned on again, and scanning is performed with the light images (Pt3, Pt4, Pt5) to the right side again at high speed. By repeating this, the white lines made of the white lights (W17, W18, W19) are disposed, and thus, a white light distribution pattern in a given shape is displayed in front of a vehicle (not shown).

Figure 8A:
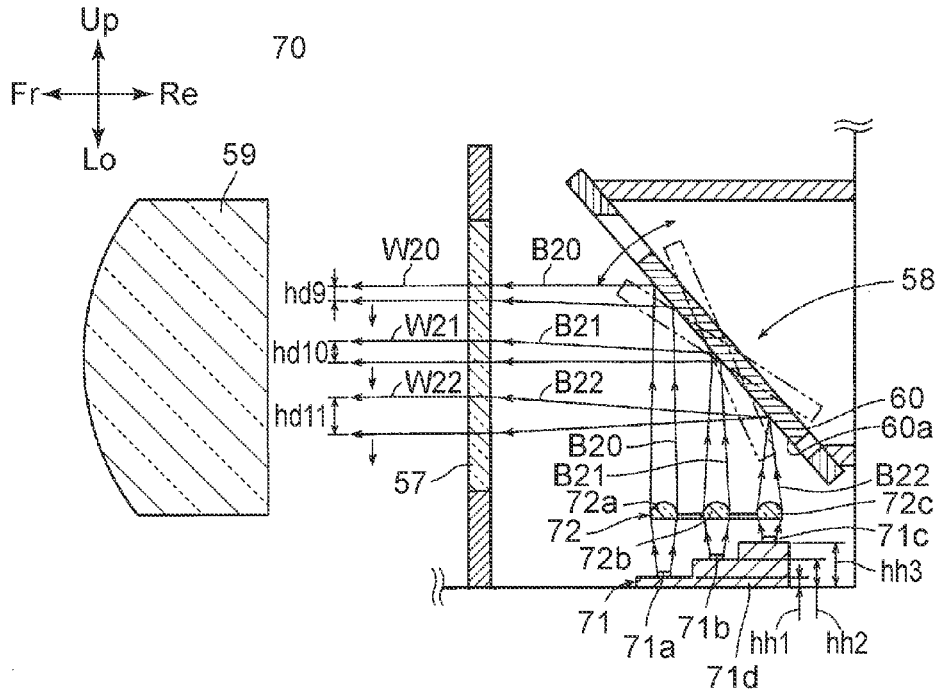
FIG. 8A is a vertical sectional view of a vehicular headlamp according to a sixth embodiment.

Next, a vehicular headlamp 70 according to a sixth embodiment is explained with reference to FIG. 8A. FIG. 8A is a vertical sectional view of the vehicular headlamp 70 according to the sixth embodiment taken along the line II-II in FIG. 1. The vehicular headlamp 70 and the vehicular headlamp 50 according to the fifth embodiment have a common structure except that structures of an excitation light source array 71 and a lens array 72 are different from the structures of the excitation light source array 55 and the lens array 56 according to the fifth embodiment.

The feature of the vehicular headlamp 70 in FIG. 8A is that the vehicular headlamp 70 includes a step-shaped excitation light source array 71 in which light emitting parts (71*a* to 71*c*) forming a plurality of excitation light sources are disposed at different heights, and a lens array 72 in which a plurality of light condensing parts (72*a* to 72*c*) having an equal light condensing magnification are disposed in a front-rear direction.

As shown in FIG. 8A, the excitation light source array 71 includes the first to third light emitting parts (71*a* to 71*c*) having the same shape. The first to third light emitting parts (71*a* to 71*c*) that form a plurality of excitation light sources are blue or purple LED light sources or laser light sources. The first to third light emitting parts (71*a* to 71*c*) are mounted on, for example, flexible printed circuit (FPC) boards (not shown) disposed along upper surfaces of a mount 71*d*. The mount 71*d* is formed to have a step shape such that heights (hh1, hh2, hh3) of the upper surfaces of the mount 71*d* satisfy the relation of hh1<hh2<hh3. The lens array 72 has a shape in which a first light condensing part 72*a*, a second light condensing part 72*b*, and a third light condensing part 72*c* are continuously arranged with each other in the front-rear direction. The first light condensing part 72*a*, the second light condensing part 72*b*, and the third light condensing part 72*c* are transparent or semitransparent, and have planoconvex lens shapes with a uniform thickness and the same curvature. The lens array 72 is fixed to a member corresponding to the support member 54 according to the fifth embodiment, in a state where the first to third light condensing parts (72*a* to 72*c*) face the corresponding first to third light emitting parts (71*a* to 71*c*), respectively.

As shown in FIG. 8A, the first to third light condensing parts (72*a* to 72*c*) of the lens array 72 condense lights (B20, B21, B22) emitted from the first to third light emitting parts (71*a* to 71*c*) of the excitation light source array 71, respectively, and make the lights (B20, B21, B22) incident on a reflection surface 60*a* of a reflecting mirror 60. Front focal distances of the first to third light condensing parts (72*a* to 72*c*) are proportional to distances to the light emitting parts (71*a* to 71*c*) facing the first to third light condensing parts (72*a* to 72*c*), respectively. Among distances from the light emitting parts (71*a* to 71*c*) to the light condensing parts (72*a* to 72*c*) facing the light emitting parts (71*a* to 71*c*), respectively, the distance to the first light condensing part 72*a* is the longest, and the distance to the third light condensing part 72*c* is the shortest. Therefore, light B22 condensed by the third light condensing part 72*c* is condensed into an area narrower than an area of light B21 condensed by the second light condensing part 72*b*, and the light B21 condensed by the second light condensing part 72*b* is condensed into the area narrower than an area of light B20 condensed by the first light condensing part 72*a*.

As shown in FIG. 8A, the lights (B20, B21, B22) incident at different positions on the reflection surface 60*a* are reflected toward the fluorescent body 57. The reflected light B22 toward the fluorescent body 57 is diffused more widely than the reflected light B21, and the reflected light B21 is diffused more widely than the reflected light B20. As a result, heights (hd9, hd10, hd11) of light images formed by the lights (B20, B21, B22) satisfy the relation of hd9<hd10<hd11. The lights (B20, B21, B22) pass through a fluorescent body and are turned into white lights (W20, W21, W22), and the white lights (W20, W21, W22) pass through a projection lens 59 and a front cover (not shown). Scanning is performed with the white lights (W20, W21, W22) in an upper-lower direction and a right-left direction based on tilting of the reflecting mirror 60 of the scanning mechanism 58. Thus, a white light distribution pattern having a given shape is displayed in front of a vehicle (not shown).

In this embodiment, the first to third light emitting parts (71*a* to 71*c*) of the excitation light source array 71 are disposed such that the first to third light emitting parts (71*a* to 71*c*) are displaced from each other in the upper-lower direction, and the first to third light condensing parts (72*a* to 72*c*) of the lens array 72 are arranged in a line in the front-rear direction. Thus, distances between the light emitting parts and the light condensing parts facing the light emitting parts, respectively, are different from each other. However, different distances may be provided by arranging the first to third light emitting parts of the excitation light source array in a line in the front-rear direction, and arranging the first to third light condensing parts of the lens array such that the first to third light condensing parts are displaced from each other in the upper-lower direction.

Figure 8B:
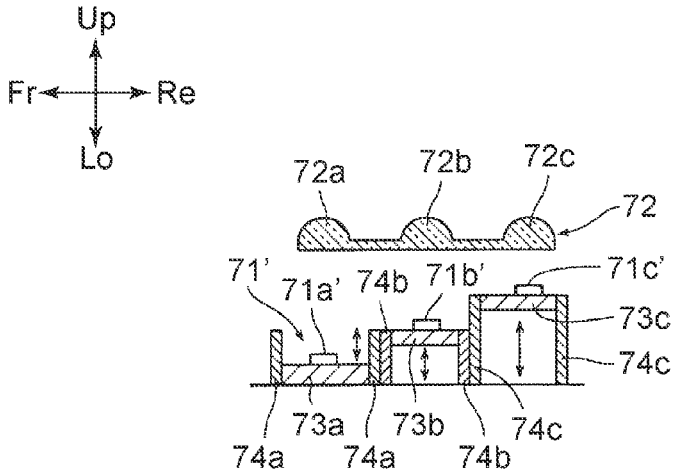
FIG. 8B is a view showing a modification of an excitation light source array according to the sixth embodiment.

FIG. 8B shows an excitation light source array 71', which is a modification of the excitation light source array 71 according to the sixth embodiment. The excitation light source array 71' is configured such that boards (73*a* to 73*c*) can be moved in an upper-lower direction. First to third light emitting parts (71*a*' to 71*c*') having the same shapes as those of the first to third light emitting parts (71*a* to 71*c*) are mounted on the boards (73*a* to 73*c*). The boards (73*a* to 73*c*) are held by slide rails (74*a* to 74*c*), and moved by, for example, a motor and a gear mechanism (both are not shown) in the upper-lower direction along the slide rails (74*a* to 74*c*). A front focal distance of each of the first to third light condensing parts (72*a* to 72*c*) becomes shorter and light diffusion from the reflecting mirror to the fluorescent body becomes higher, as a corresponding one of the first to third light emitting parts (71*a*' to 71*c*') is moved closer to the light condensing part (72*a* to 72*c*), by moving the corresponding board (73*a* to 73*c*). In this embodiment, instead of employing the configuration where the boards (73*a* to 73*c*) on which the first to third light emitting parts (71*a*' to 71*c*') are mounted are movable in the upper-lower direction, the first to third light condensing parts (72*a* to 72*c*) of the lens array 72 may be configured independently of each other, and the first to third light condensing parts (72*a* to 72*c*) may be held by slide rails, respectively, so as to slide in the upper-lower direction such that distances to the first to third light emitting parts (71*a*' to 71*c*') are changed.

In the vehicular headlamps according to the first to sixth embodiments, a low-beam light source unit is provided in addition to the high-beam light source unit. However, a high-beam light distribution pattern and a low-beam light distribution pattern may be displayed selectively or simultaneously by performing scanning on different areas using lights from light sources of a single light source unit. Further, in the first embodiment to the fourth embodiment, two excitation light sources and two condenser lenses are provided, and, in the fifth embodiment and the sixth embodiment, three light emitting parts are provided in the excitation light source array and three lenses are provided in the lens array. However, the numbers of the excitation light sources, the condenser lenses, the light emitting parts in the excitation light source array, and light condensing parts in the lens array are not limited to above numbers.

What is claimed is:

1. A vehicular headlamp comprising:

a plurality of excitation light sources;

a fluorescent body;

a scanning mechanism configured to perform scanning by directing lights emitted from the excitation light sources toward the fluorescent body; and a projection lens through which the lights emitted from the fluorescent body pass such that a light distribution pattern is formed, wherein sizes of light images, formed by the lights emitted from the excitation light sources and incident on the fluorescent body, are different from each other.

2. The vehicular headlamp according to claim 1, wherein:

a lens array is provided between the excitation light sources and the scanning mechanism, the lens array including a plurality of light condensing parts disposed so as to face the excitation light sources, respectively; and the light condensing parts have light condensing magnifications different from each other.

3. The vehicular headlamp according to claim 1, wherein:

a lens array is provided between the excitation light sources and the scanning mechanism, the lens array including a plurality of light condensing parts disposed so as to face the excitation light sources, respectively; and the light condensing parts and the excitation light sources are disposed such that distances from the light condensing parts to the excitation light sources facing the light condensing parts, respectively, are different from each other.

4. The vehicular headlamp according to claim 3, wherein: each of the light condensing parts is configured to move with respect to a corresponding one of the excitation light sources facing the light condensing part such that the distance from the light condensing part to the corresponding one of the excitation light sources is changed, or each of the excitation light sources is configured to move with respect to a corresponding one of the light condensing parts facing the excitation light source such that the distance from the excitation light source to the corresponding one of the light condensing parts is changed.

5. The vehicular headlamp according to claim 1, wherein light emitting parts of the excitation light sources have shapes different from each other.

6. The vehicular headlamp according to claim 1, wherein the scanning mechanism includes a reflecting portion configured to reflect the lights emitted from the excitation light sources toward the fluorescent body.

7. The vehicular headlamp according to claim 1, wherein a plurality of the scanning mechanisms are provided, and each of the scanning mechanisms includes a reflecting portion configured to reflect the light emitted from a corresponding one of the excitation light sources toward the fluorescent body.

8. The vehicular headlamp according to claim 7, wherein: a plurality of condenser lenses are provided such that each of the condenser lenses faces a corresponding one of the excitation light sources, and is disposed between the corresponding one of the excitation light sources and a corresponding one of the reflecting portions; and the condenser lenses have light condensing magnifications different from each other.

9. The vehicular headlamp according to claim 7, wherein incidence angles of the lights emitted from the excitation light sources and incident on the reflecting portions are different from each other.

* * * * *